US007073730B2

(12) United States Patent
Haag et al.

(10) Patent No.: US 7,073,730 B2
(45) Date of Patent: Jul. 11, 2006

(54) FUEL INJECTION VALVE

(75) Inventors: Gottlob Haag, Markgroeningen (DE); Michael Huebel, Gerlingen (DE); Juergen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,269

(22) PCT Filed: Jun. 11, 2002

(86) PCT No.: PCT/DE02/02120

§ 371 (c)(1),
(2), (4) Date: Oct. 9, 2003

(87) PCT Pub. No.: WO03/018993

PCT Pub. Date: Mar. 6, 2003

(65) Prior Publication Data

US 2004/0074999 A1 Apr. 22, 2004

(30) Foreign Application Priority Data

Aug. 20, 2001 (DE) ..... 101 40 796

(51) Int. Cl.
*B05B 1/08* (2006.01)

(52) U.S. Cl. ..... 239/102.2

(58) Field of Classification Search ..... 239/102.1, 239/102.2

See application file for complete search history.

(56) References Cited

U.S. PATENT DOCUMENTS

| | | | | |
|---|---|---|---|---|
| 6,079,636 | A * | 6/2000 | Rembold et al. | 239/88 |
| 6,142,443 | A * | 11/2000 | Potschin et al. | 251/57 |
| 6,776,354 | B1 * | 8/2004 | Cooke | 239/102.2 |

FOREIGN PATENT DOCUMENTS

| | | |
|---|---|---|
| DE | 374 2241 | 8/1988 |
| DE | 195 00 706 | 7/1996 |
| DE | 197 43 640 | 4/1999 |
| DE | 197 46 143 | 4/1999 |
| DE | 197 436 69 | 4/1999 |
| DE | 100 06 319 | 8/2001 |
| EP | 0 477 400 | 4/1992 |
| EP | 0 972 934 | 1/2000 |
| WO | WO 99/18348 | 4/1999 |

* cited by examiner

*Primary Examiner*—Christopher Kim
(74) *Attorney, Agent, or Firm*—Kenyon & Kenyon LLP

(57) ABSTRACT

A fuel injector, in particular a fuel injector for fuel-injection systems of internal combustion engines, including a piezoelectric or magnetostrictive actuator, actuates a valve-closure member formed on a valve needle via a hydraulic coupler, the valve-closure member cooperating with a valve-seat surface to form a valve-sealing seat. The coupler includes a master piston and a slave piston which are connected to a pressure chamber, and at least one coupler-spring element which in each instance produces a prestressing force on the master piston, counter to a working direction, and on the slave piston, in a working direction. The pressure chamber of the coupler is connected to a fuel inflow in the flow-through direction to the pressure chamber via an inflow bore and a check valve.

8 Claims, 2 Drawing Sheets

FUEL INJECTION VALVE

FIELD OF THE INVENTION

The present invention relates to a fuel injector.

BACKGROUND INFORMATION

European Patent Application No. 0 477 400 discusses a system for an adaptive, mechanical tolerance compensation, acting in the lift direction, for a path transformer of a piezoelectric actuator for a fuel injector. In this case, the actuator acts on a master (transmitter) piston connected to an hydraulic chamber, and a slave (receiving) piston, moving a mass to be driven and positioned, is moved via the pressure increase in the hydraulic chamber. This mass to be driven is, for example, a valve needle of a fuel injector. The hydraulic chamber is filled with an hydraulic fluid. When the actuator is deflected and the hydraulic fluid in the hydraulic chamber compressed, a small portion of the hydraulic fluid leaks at a defined leakage rate. In the rest phase of the actuator, this hydraulic fluid is replenished.

German Published Patent Application No. 195 00 706 discusses a hydraulic path transformer for a piezoelectric actuator in which a master piston and a slave piston are lying on a common axis of symmetry and the hydraulic chamber is located between the two pistons. A spring, which presses apart the master cylinder and the slave piston, is located in the hydraulic chamber, the master piston being prestressed in the direction of the actuator and the slave piston being prestressed in a working direction of a valve needle. When the actuator transmits a lifting movement to the master cylinder, this lifting movement is transmitted to the slave piston by the pressure of a hydraulic fluid in the hydraulic chamber since the hydraulic fluid in the hydraulic chamber is not compressible and during the short duration of a lift only a very small portion of the hydraulic fluid is able to escape through ring gaps between the master piston and a guide bore, and a slave piston and a guide bore.

In the rest phase, when the actuator does not exert any pressure on the master piston, the spring pushes apart the master piston and the slave piston, and, due to the produced vacuum pressure, the hydraulic fluid enters the hydraulic chamber via the ring gaps and refills it. In this manner, the path transformer automatically adapts to longitudinal deformations and pressure-related extensions of a fuel injector.

In other systems, hydraulic fluid may evaporate during a relief period in which no high pressure prevails in the hydraulic chamber. However, gas is compressible and generates an appropriately high pressure only after a substantial reduction in volume. The master cylinder may then be pressed into its guide bore without a force being transmitted to the slave piston.

This danger exists, in particular, in a fuel injector used for injecting gasoline as fuel, in those instances where the gasoline is also used as the hydraulic fluid. This danger is increased even further in the case of a directly injecting fuel injector for gasoline once a hot internal combustion engine has been switched off. A fuel-injection system then loses its pressure, and the gasoline evaporates particularly easily. In a renewed effort to start the internal combustion engine, this may lead to the lifting movement of the actuator no longer being transmitted to a valve needle and the fuel injector no longer functioning.

A cavitation of the fuel may occur if the spring exerts a high clamping force upon the master cylinder and the slave cylinder and the movement of the actuator into its original position occurs very rapidly. The vacuum pressure being generated in the hydraulic chamber may then lead to cavitation and to damage of components resulting therefrom.

SUMMARY OF THE INVENTION

The fuel injector according to the present invention may provide that, given vacuum pressure in the pressure chamber, the check valve opens and releases a connection to the fuel inflow. The coupler-spring element exerts a force upon the master piston and the slave piston in an attempt to increase the volume of the pressure chamber when the coupler does not assume the maximally possible length as transmission element between the actuator and the valve needle. Due to the relatively large cross section of the inflow bore, it is then possible for fuel to continue flowing into the pressure chamber until the check valve closes at pressure parity in the pressure chamber and the fuel inflow, and the coupler assumes the maximally possible length as transmission element between the actuator and the valve needle.

The rapid refilling of the hydraulic chamber may be advantageous in those cases when, after considerable loading and, thus, high temperature of the fuel injector, gas has formed in the pressure chamber following a standstill of an internal combustion engine. Since no, or only low, pressure prevails in the fuel inflow in the shut-off state of the internal combustion engine, it may happen that the fuel, due to the gas of the possibly evaporating fuel, is pressed into the fuel inflow through the ring gap between the master piston and the slave piston and the respective guide bores. When the internal combustion engine is started, the actuator exerts a lifting force on the coupler. However, since gas is compressible, this lifting movement is no longer transmitted to the valve needle. In contrast, in the fuel injector according to the present invention, the check valve is opened as soon as the fuel pressure in the fuel inflow rises, and fuel under overpressure flows into the pressure chamber. This fuel compresses the gas and at the same time cools the pressure chamber, thereby causing the evaporated fuel to condense.

Furthermore, the fuel injector according to the present invention may provide that expansions of the fuel injector caused by temperature changes and changes in the fuel pressure, are automatically compensated in the transmission path between the actuator and valve needle. The lift of the valve needle is always unchanged.

The master piston and the slave piston may lie on a common axis and in a common guide bore, the pressure chamber being arranged between them.

This example embodiment of the fuel injector according to the present invention is simple to produce since only one precise bore is required for the master piston and the slave piston.

The check valve may be a ball-check valve and a valve seat of the ball-check valve is formed on the slave piston, the inflow bore penetrating the slave piston.

In an example embodiment, the ball-check valve is stressed by a ball-valve spring which is arranged in a spring bore of the master piston. Relative to the guide bore, the spring bore has a diameter such that the wall thickness of the master piston that remains relative to the diameter of the guide bore is low.

A considerable part of the installation volume of the check valve may be located inside the master piston, so that the coupler as a whole may have a shorter configuration in its longitudinal extension. Furthermore, due to the fuel pressure, the master piston may be expanded in the region of the spring bore, since the remaining wall thickness is only low, and the ring gap leading to leakage losses is reduced.

The ball-valve spring may simultaneously be the coupler-spring element.

An additional component may be saved.

DETAILED DESCRIPTION

Figure 1:
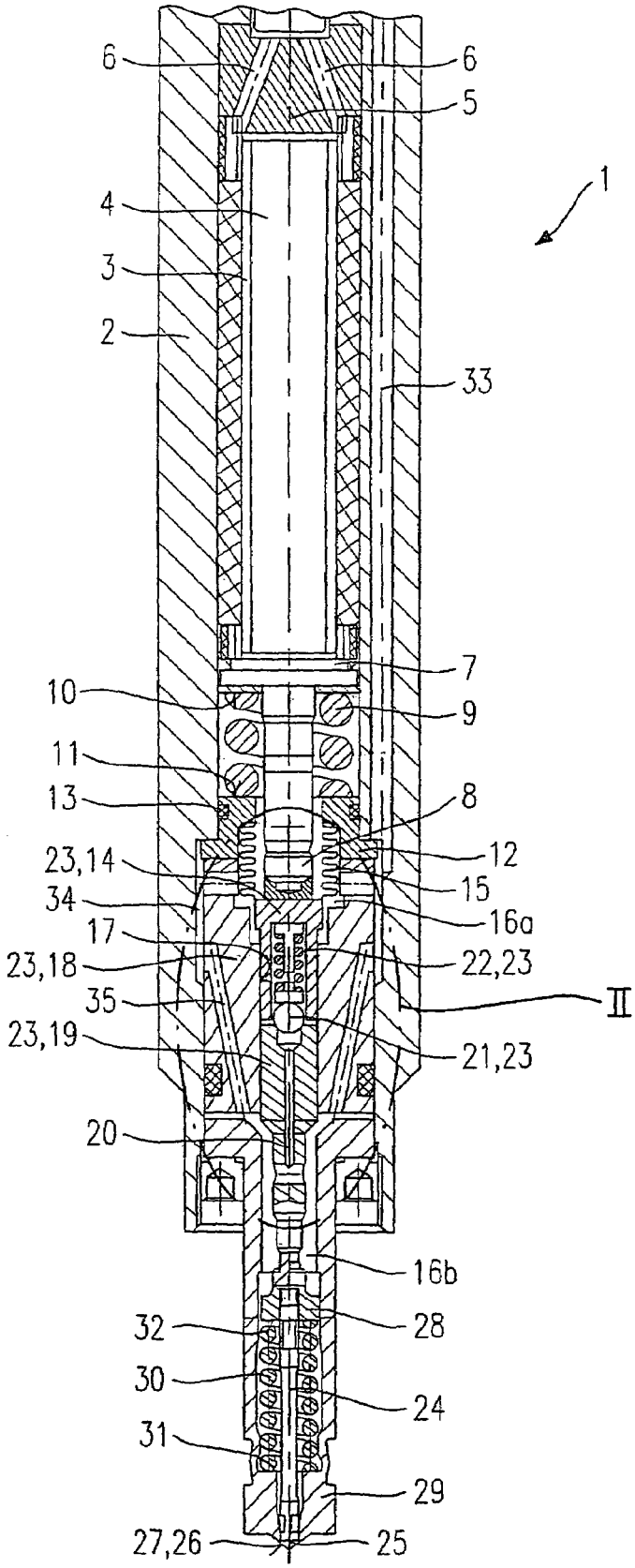
FIG. 1 shows a schematic section through an example embodiment of a fuel injector configured according to the present invention.

FIG. 1 shows a schematic section through an example embodiment of a fuel injector 1 configured according to the present invention. An actuator 4 is located in a valve body 2 in an actuator chamber 3, actuator 4 abutting against an actuator-support element 5. Two connecting bores 6 are used to supply electrical connecting lines for actuator 4. Actuator 4 is controlled via the connecting lines (not shown). Actuator 4 transmits its lifting movement to an actuator head 7, which is integrally formed with a tappet 8. An actuator spring 9, which abuts against a first spring system 10 of actuator head 7 and a second spring system 11 of an intermediate piece 12, exerts a prestressing force on actuator head 7, so that actuator head 7 rests against actuator 4. A sealing ring 13 seals intermediate piece 12 from valve body 2. Tappet 8 penetrates intermediate piece 12 and transmits a lifting movement of actuator 4 and actuator head 7 to a master piston 14. A corrugated tube 15 is sealingly connected to the intermediate piece at one side. The other side of corrugated tube 15 is likewise sealingly connected to master piston 14. Actuator chamber 3 is sealingly sealed from an upper fuel chamber 16*a* by sealing ring 13, intermediate piece 12, corrugated tube 15 and master piston 14.

Master piston 14 is inserted in a guide bore 17 of a coupler support 18. Inserted in the same guide bore 17 is a slave piston 19 which is penetrated in its longitudinal axis by an inflow bore 20. Inflow bore 20 is sealed by a ball 21 of a ball check valve, which is prestressed by a ball spring 22. Coupler support 18, master piston 14, slave piston 19 and ball spring 22 as well as ball 21 form hydraulic coupler 23 whose structure is described in FIG. 2 below.

Slave piston 19 transmits its lifting movement to a valve needle 24 via a valve-needle head 28. Valve needle 24 includes a valve-closure member 25, which is integrally formed with valve needle 24 and cooperates with a valve-seat surface 26 formed on a valve-seat support 29 to form a valve-sealing seat 27. Fuel injector 1 includes a valve needle 24 that opens toward the outside and lifts off from valve-sealing seat 27 toward a combustion chamber, releasing an annular spray-discharge orifice once fuel injector 1 opens. A valve spring 30 abuts against a first spring system 31 of valve-seat support 29 and, via a second spring system 32 formed at valve-needle head 28, exerts an initial stress on valve spring 30 in a closing direction, which presses valve-closure member 25 against valve-sealing seat 27.

Via a fuel-inflow bore 33 in valve body 2, the fuel may flow from a fuel inflow (not shown) to upper fuel chamber 16*a*. The fuel flows to lower fuel chamber 16*b* and further to valve-sealing seat 27 via openings 34 in valve body 2 and fuel bores 35 in coupler support 18.

Figure 2:
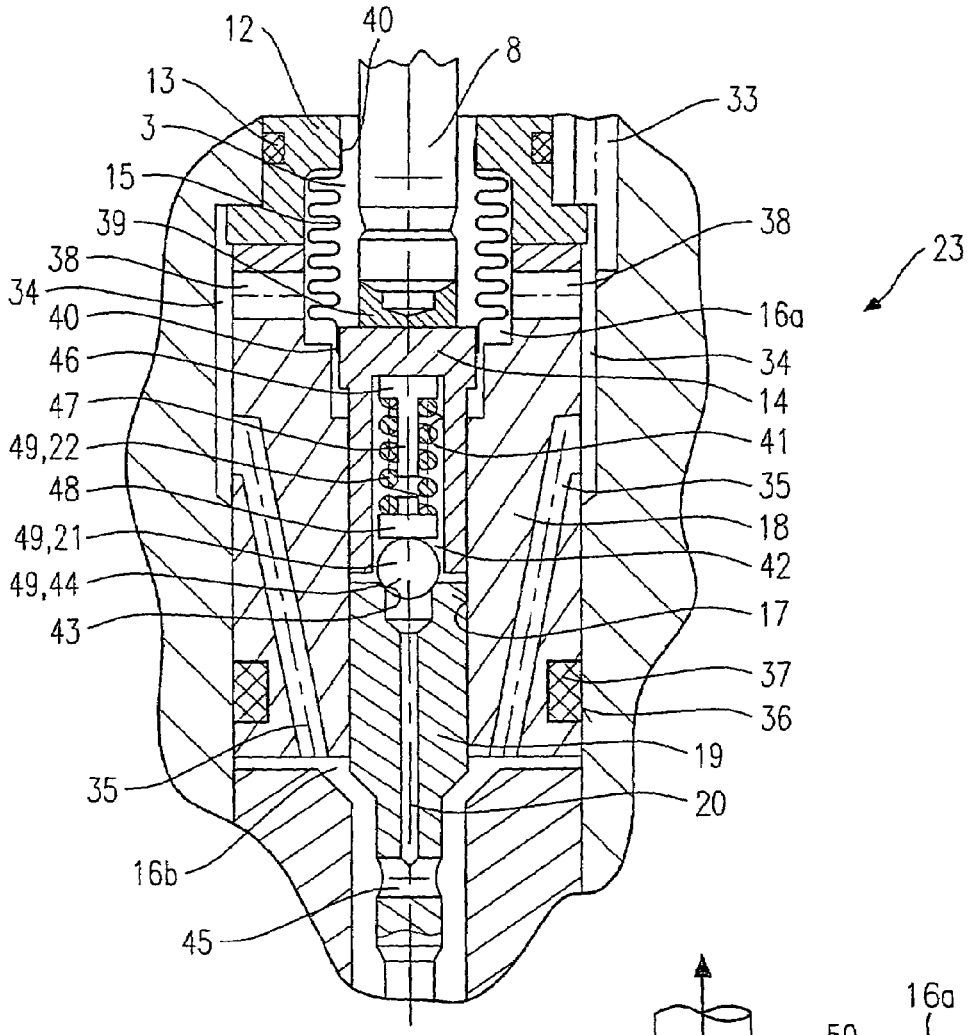
FIG. 2 shows a schematic section, in region II of FIG. 1, through the fuel injector configured according to the present invention.

FIG. 2 shows a schematic section through fuel injector 1 configured according to the present invention, in region II of FIG. 1. Components already discussed in connection with FIG. 1 have been provided with the same reference numerals. The cut-out section shows hydraulic coupler 23 with master piston 14 and slave piston 19. Master piston 14 and slave piston 19 are inserted in a shared guide bore 17 of coupler support 18. Coupler support 18 in turn is inserted in a bore 36 of valve body 2 and sealed by a ring 37 made of an elastomeric material. Via connecting bores 38 in coupler support 18, fuel-inflow bore 33 in valve body 2 is connected to upper fuel chamber 16*a*. Fuel flows to lower fuel chamber 16*b* via the openings in valve body 2 and fuel bores 35 in coupler support 18.

Tappet 8 which is integrally formed with actuator head 7 in FIG. 1, penetrates intermediate piece 12 and abuts against master piston 14 by manner of a molded part 39. A corrugated tube 15 is sealingly connected to the intermediate piece on one side. The other side of corrugated tube 15 is likewise sealingly connected to master piston 14. These connections consist, for instance, of a slight pressure fit or soldering, welding or bonding of sleeve-shaped sections 40 of corrugated tube 15 to master piston 14 and/or intermediate piece 12. Sealing ring 13, intermediate piece 12, corrugated tube 15 and master piston 14 sealingly seal actuator chamber 3 from upper fuel chamber 16*a*.

Master piston 14 includes a spring bore 41 whose diameter is smaller than the diameter of guide bore 17 to only such an extent that the wall thickness of master piston 14 that remains in the region of spring bore 41 is relatively small. Inside spring bore 41 and in guide bore 17, between master piston 14 and slave piston 19, is a pressure chamber 42.

Slave piston 19 is penetrated in its longitudinal axis by inflow bore 20. Inflow bore 20 is sealed by ball 21 which is prestressed by ball spring 22 and forms a ball-sealing seat 44 together with outlet 43 of inflow bore 20. Ball-check valve 49 is made up of ball-sealing seat 44, ball 21 and ball spring 22. Inflow bore 20 is connected to lower fuel chamber 16*b* via a transverse bore 45 in slave piston 19. Ball spring 22, via a spring-pressure piece 46 which includes a spring-guide section 47, abuts against master piston 14. By manner of its other end, ball spring 22 is braced on ball 21 via a ball-pressure piece 48. Thus, ball spring 22 presses ball 21 into ball-sealing seat 44 and simultaneously provides master piston 14 with an initial stress in the direction of actuator 4 and slave piston 19 with an initial stress in the direction of valve needle 24.

Figure 3:
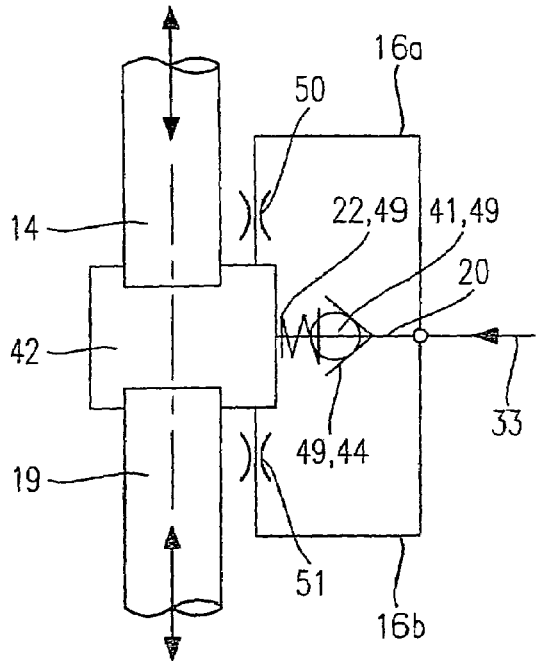
FIG. 3 shows an hydraulic circuit diagram of the coupler of the fuel injector shown in FIG. 1.

FIG. 3 shows an hydraulic circuit diagram of the coupler of fuel injector 1 of FIG. 1. Master piston 14 and slave piston 19 are represented in a schematized form as pistons acting on pressure chamber 42 arranged between them. In order to make it easier to find the components that correspond to the circuit symbols, the circuit symbols are denoted by the reference numerals corresponding to the components in FIG. 1 and FIG. 2. Via inflow bore 20, fuel is able to flow as hydraulic fluid from fuel-inflow bore 33 via ball-check valve 49, made up of ball-sealing seat 44, ball 21 and ball spring 22, in the flow-through direction of ball-check valve 49 into pressure chamber 42. The ring gap existing between master piston 14 and guide bore 17 of coupler support 18 in FIG. 2 acts as a master-piston throttle 50 by manner of which pressure chamber 42 is connected to upper fuel chamber 16*a*. The ring gap existing between slave piston 19 and guide bore 17 of coupler support 18 in FIG. 2 likewise acts as a slave-piston throttle 51 by manner of which pressure chamber 42 is connected to lower fuel chamber 16*b*.

In response to a voltage being applied to actuator 4, actuator 4 exerts a lifting force on actuator head 7 and tappet 8 in FIG. 1. This lifting force is transmitted to master piston 14 which is moved in guide bore 17 toward slave piston 19. This causes the pressure in pressure chamber 42 to rise rapidly since the fuel contained in pressure chamber 42 is incompressible as fluid. Slave piston 19 is pushed out of guide bore 17 onto valve needle 24 and lifts valve needle 24 out of valve-sealing seat 27. Since the duration of the lift is relatively short, during the lift only a relatively small quantity of fuel is able to flow into upper fuel chamber 16*a* or lower fuel chamber 16*b* via the ring gap between master piston 14 and guide bore 17 and between slave piston 19 and guide bore 17. This corresponds to the flow rate of the fuel from pressure chamber 42 via master-piston throttle 50 into upper fuel chamber 16*a* and the flow rate of the fuel via slave-piston throttle 51 into lower fuel chamber 16*b* in the hydraulic circuit diagram of FIG. 3, as a function of the overpressure prevailing in pressure chamber 42. Ball-check valve 49 is acted upon in its blocking direction by the overpressure in pressure chamber 42 relative to lower and upper fuel chambers 16*a*, 16*b* and fuel-inflow bore 33, and closes.

When the voltage drops at actuator 4, actuator spring 9 presses actuator head 7 into its rest position onto actuator 4, and valve needle 24 is pressed into valve-sealing seat 27. A coupler-spring element, which simultaneously is ball spring 22 in the present example embodiment, exerts a force upon master piston 14 and slave piston 19 in an attempt to increase the volume of pressure chamber 42 when hydraulic coupler 23 fails to assume the maximally possible length as transmission element between actuator 4 and valve needle 24.

Due to ball-check valve 49 and inflow bore 20 of slave piston 19, it is now possible for fuel to continue flowing into pressure chamber 42 until ball-check valve 49 closes at pressure parity in pressure chamber 42 and the fuel inflow, and coupler 23 assumes the maximally possible length as transmission element between actuator 4 and valve needle 24. The rapid refilling of pressure chamber 42 may be advantageous in those instances when, following a standstill of an internal combustion engine after considerable loading and, thus, high temperature of the fuel injector, gas has formed in pressure chamber 42. As soon as the fuel pressure in fuel-inflow bore 33 rises, ball-check valve 49 is opened and fuel under overpressure flows into pressure chamber 42. This fuel compresses the gas and simultaneously cools pressure chamber 42, thereby condensing the evaporated fuel.

A cavitation of the fuel may be avoided when the volume of pressure chamber 42 increases rapidly, since a negative pressure in pressure chamber 42 is quickly compensated by the fuel that continues to flow via ball-check valve 49. Therefore, fuel injector 1 according to the present invention may allow the use of an hydraulic coupler 23 that may allow temperature and expansion compensation at simultaneously very rapid opening and closing movements of valve needle 24.

Due to the low wall thickness of master piston 14 in the region of spring bore 41, a widening of the ring gap of master piston 14 relative to guide bore 17 in response to overpressure in pressure chamber 42 is reduced and the corresponding flow rate of fuel through master-piston throttle 50 of the circuit diagram of FIG. 3 minimized.

What is claimed is:

1. A fuel injector for a fuel-injection system of an internal combustion engine, comprising:

a valve-seat surface;

a valve needle;

a hydraulic coupler;

a valve-closure member formed at the valve needle via the hydraulic coupler, the valve-closure member cooperating with the valve-seat surface to form a valve-sealing seat and the hydraulic coupler including a master piston and a slave piston that are connected to a pressure chamber; and an actuator that is one of piezoelectric and magnetostrictive, the actuator actuating the valve-closure member;

wherein the hydraulic coupler includes a ball-check valve including a ball-sealing seat, a ball and a ball-valve spring, wherein the ball-valve spring simultaneously operates as a coupler-spring element for generating a prestressing force on the master piston counter to a working direction and on the slave piston in the working direction, wherein the ball-valve spring with its one end abuts against the master piston via a spring-pressure piece and on its other end is braced on the ball via a ball-pressure piece;

wherein the pressure chamber is connected to a fuel-inflow in a flow-through direction of the pressure chamber via an inflow bore and the ball-check valve.

2. The fuel injector of claim 1, wherein the master piston and the slave piston lie on a common axis and the pressure chamber is located between the master piston and the slave piston.

3. The fuel injector of claim 2, wherein the master piston and the slave piston are located in a common guide bore and have a same working direction.

4. The fuel injector of claim 1, wherein a valve seat of the ball-check valve is formed on the slave piston and the inflow bore penetrates the slave piston.

5. The fuel injector of claim 1, wherein the ball-valve spring is located in a spring bore of the master piston.

6. The fuel injector of claim 5, wherein the spring bore, in relation to the common guide bore, has a diameter of such a size that a wall thickness of the master piston that remains in relation to a diameter of the common guide bore is low such that a widening of the ring gap of the master piston relative to the guide bore in response to overpressure in the pressure chamber is reduced.

7. The fuel injector of claim 1, wherein the master piston is connected by force-locking to an actuator-compression element of the actuator, and wherein the ball-valve spring, which simultaneously operates as the coupler-spring element of the master piston, operates as an additional actuator-compression spring element.

8. The fuel injector of claim 1, wherein the slave piston is connected by force-locking to the valve needle.

* * * * *